US005681359A

United States Patent [19]

Botros

[11] Patent Number: 5,681,359

[45] Date of Patent: Oct. 28, 1997

[54] ETHYLENE VINYL ACETATE AND ISOBUTYLENE TERPOLYMER AS A COLD FLOW IMPROVER FOR DISTILLATE FUEL COMPOSITIONS

[75] Inventor: Maged G. Botros, West Chester, Ohio

[73] Assignee: Quantum Chemical Corporation, Cincinnati, Ohio

[21] Appl. No.: 735,291

[22] Filed: Oct. 22, 1996

[51] Int. Cl.[6] ..... C10L 1/18

[52] U.S. Cl. ..... 44/393; 525/222

[58] Field of Search ..... 44/393; 525/222

[56] References Cited

U.S. PATENT DOCUMENTS

| | | | |
|---|---|---|---|
| 3,048,479 | 8/1962 | Ilnyckyj . | |
| 3,126,364 | 3/1964 | Ilnyckyj . | |
| 3,254,063 | 5/1966 | Ilnyckyj . | |
| 3,467,597 | 9/1969 | Tunkel . | |
| 3,627,838 | 12/1971 | Ilnyckyj et al. . | |
| 3,638,349 | 2/1972 | Wisotsky et al. . | |
| 3,846,092 | 11/1974 | Pappas . | |
| 3,961,916 | 6/1976 | Ilnyckyj et al. . | |
| 3,981,850 | 9/1976 | Wisotsky et al. . | |
| 4,014,662 | 3/1977 | Miller et al. . | |
| 4,087,255 | 5/1978 | Wisotsky et al. . | |
| 4,178,950 | 12/1979 | Sweeney . | |
| 4,178,951 | 12/1979 | Sweeney . | |
| 4,210,424 | 7/1980 | Feldman et al. . | |
| 4,375,973 | 3/1983 | Rossi et al. . | |
| 4,746,327 | 5/1988 | Smyser . | |
| 4,908,146 | 3/1990 | Smith, Jr. . | |
| 4,932,980 | 6/1990 | Mueller et al. | 44/393 |
| 5,256,166 | 10/1993 | Fischer . | |
| 5,364,419 | 11/1994 | Tack et al. . | |
| 5,423,890 | 6/1995 | More et al. . | |
| 5,554,200 | 9/1996 | Brod et al. | 44/393 |

FOREIGN PATENT DOCUMENTS

| | | |
|---|---|---|
| 0045342 | 7/1980 | European Pat. Off. . |
| 0099646 | 1/1984 | European Pat. Off. . |
| 0196217 | 10/1986 | European Pat. Off. . |
| 0254284 | 1/1988 | European Pat. Off. . |
| 2061457 | 5/1971 | France . |
| 56-141390 | 11/1981 | Japan . |
| 61-87985 | 12/1986 | Japan . |
| 988028 | 3/1965 | United Kingdom . |
| 1374051 | 11/1974 | United Kingdom . |
| 1462628 | 1/1977 | United Kingdom . |

OTHER PUBLICATIONS

Data Sheet entitled "Vynathene ® L", by Quantum Chemical Company (undated).

D. A. Daniels and E. R. Eaton, Observations on Successful Management and Problem Solution of Wax Related Low Temperature Flow Properties of Low Sulphur Diesel Fuels, presented at Fuels & Lubricants Meeting & Exposition, Toronto, Ontario, Oct. 16–19, 1995, 17 pp.

Automotive Diesel Fuels – Fuel Products Quality, Engine Design and Opportunities, Section 5: Cold Flow Improver Additives, presented at Oxford Careers Centre, Oxford, Apr. 18–19, 1994, 8 pp.

Hoechst Brochure, "Petroleum and the Refinery", 14 pp (undated).

Data Sheet entitled "Vynathene ® L EY–706–01", by Quantum Chemical Company (undated).

*Primary Examiner*—Jacqueline V. Howard
*Attorney, Agent, or Firm*—Gerald A. Baracka; William A. Heidrich

[57] ABSTRACT

Terpolymers of ethylene, vinyl acetate and isobutylene as flow improvers in distillate fuels. The terpolymers have number average molecular weights in the range of about 1,600 to about 3,000, and weight average molecular weights in the range of about 4,000 to about 18,000. These terpolymers provide improved low temperature flow characteristics in middle distillate fuels.

24 Claims, No Drawings

ETHYLENE VINYL ACETATE AND ISOBUTYLENE TERPOLYMER AS A COLD FLOW IMPROVER FOR DISTILLATE FUEL COMPOSITIONS

FIELD OF THE INVENTION

This invention relates to terpolymers of ethylene, vinyl acetate and isobutylene useful as cold flow improvers as measured by pour point, cold filter plugging point or other low temperature flow tests in distillate fuels, and particularly in hard-to-treat fuels.

BACKGROUND OF THE INVENTION

Distillate fuels such as diesel fuels tend to exhibit reduced flow at reduced temperatures. This reduced flow affects the transport and use of the distillate fuels not only in the refinery but also in an internal combustion engine. If the distillate fuel is cooled to below a temperature at which solid formation begins to occur in the fuel, generally known as the cloud point (ASTM D 2500) or wax appearance point (ASTM D 3117), solids forming in the fuel will essentially prevent the flow of the fuel, plugging piping in the refinery or during transport of the fuel, as well as in inlet lines supplying an engine. During consumption of the distillate fuel, as in a diesel engine, but under low temperature conditions, wax precipitation and gelation can cause the engine filter to plug.

As used herein, distillate fuels encompass a range of fuel types, typically including but not limited to, kerosene, intermediate distillates, lower volatility distillate gas oils, and higher viscosity distillates. Grades encompassed by the term include Grades No. 1-D, 2-D and 4-D as defined in ASTM D 975 for diesel fuels. The distillate fuels are useful in a range of applications, including use in automotive diesel engines and in non-automotive applications under both varying and relatively constant speed and load conditions.

The cold flow behavior of a distillate fuel such as diesel fuel is a function of composition. The fuel is comprised of a mixture of hydrocarbons including normal paraffins, branched paraffins, olefins, aromatics and other non-polar and polar compounds. As the diesel fuel temperature decreases at the refinery, during transport, or in a vehicle, one or more components of the fuel will tend to separate, or precipitate, as a wax.

The components of the diesel fuel having the lowest solubility tend to be the first to separate as solids from the fuel with decreasing temperature. Straight chain hydrocarbons, such as normal paraffins, generally have the lowest solubility in the diesel fuel. Generally, the paraffin crystals which separate from the diesel fuel appear as individual crystals. As more crystals form in the fuel, they ultimately create a network in the form of a gel to eventually prevent the flow of the fuel.

It is known to incorporate additives into diesel fuel to enhance the flow properties of the fuel at low temperatures. These additives are generally viewed as operating under either or both of two mechanisms. In the first, the additive molecules have a configuration which allow them to interact with the n-paraffin molecules at the growing ends of the paraffin crystals. The additive molecules by steric effects act as a cap to prevent additional paraffin molecules from adding to the crystal, thereby limiting the length of the existing crystal. The ability of the additive to limit the length of the growing paraffin crystal is evaluated by low temperature optical microscopy or by the pour point depression (PPD) test, ASTM D 97, incorporated herein by reference.

In the second, the flow modifying additive may improve the flow properties of diesel fuel at low temperatures by functioning as a nucleator to promote the growth of smaller size crystals. The average size of the modified crystals is approximately one micron. This modified crystal shape passes more easily through a filter, and the ability of the additive to improve flow by altering the n-paraffin crystallization behavior is normally evaluated by tests such as the Cold Filter Plugging Point (CFPP) Test, IP 309, incorporated herein by reference.

The range of available diesel fuels includes Grade No. 2-D, defined in ASTM D 975-90 as a general purpose, middle distillate fuel for automobile diesel engines, which is also suitable for use in non-automotive applications, especially in conditions of frequently varying speed and load. Certain of these Grade No. 2-D (No. 2) fuels may be classified as being hard to treat with one or more additives to improve flow. A hard-to-treat diesel fuel is either unresponsive to a flow improving additive, or requires increased levels of additive(s) relative to a normal fuel to effect flow improvement.

Fuels in general, and diesel fuels in particular, are mixtures of hydrocarbons of different chemical types (i.e., paraffins, aromatics, olefins, etc.) wherein each type may be present in a range of molecular weights and carbon lengths. Resistance to flow is a function of one or more properties of the fuel, the properties being attributable to the composition of the fuel. Compositional properties which render a fuel hard to treat relative to normal fuels include a narrower wax distribution; the virtual absence of very high molecular weight waxes, or inordinately large amounts of very high molecular weight waxes; a higher total percentage of wax; and a higher average normal paraffin carbon number range. It is difficult to generate a single set of quantitative parameters which define a hard-to-treat fuel. Nevertheless, measured parameters which tend to identify a hard-to-treat middle distillate fuel include a temperature range less than 100° C. between the 20% distilled and 90% distilled temperatures (as determined by test method ASTM D 86 incorporated herein by reference), a temperature range less than 25° C. between the 90% distilled temperature and the final boiling point (see ASTM D 86), and a final boiling point above or below the temperature range 360° to 380° C.

There continues to be a demand for additives which improve the flow properties of distillate fuels. Further, there remains a need for additive compositions which are capable of improving the flow properties of hard-to-treat fuels.

The use of terpolymers of ethylene, vinyl acetate and monolefinically unsaturated polymerizable monomers has been disclosed for use as cold flow improvers. For example, U.S. Pat. No. 3,467,597 discloses terpolymers of ethylene, vinyl acetate and butylenes. U.S. Pat. No. 3,638,349 discloses copolymers of ethylene and vinyl acetate wherein up to 20% of the copolymer can be other polymerizable unsaturated monomers. U.S. Pat. No. 4,178,950 discloses terpolymers of ethylene, vinyl acetate and butylene prepared by solution polymerization having a number average molecular weight of about 5,000 to about 80,000, preferably 12,000 to about 60,000. European Patent Application 0 099 646 disclosures terpolymers of ethylene vinyl acetate and an iso olefin such as isobutylene with a number average molecular weight of from 1,500 to 5,500, a very high melt index and a vinyl acetate content of from 10% to 20% by weight. U.S. Pat. No. 5,256,166, incorporated herein by reference, discloses clear terpolymers of ethylene, vinyl acetate and isobutylene having number average molecular weights from about 400 to about 1,200, and weight average molecular weights from about 1,500 to about 3,000.

Great Britain Patent No. 988,028 discloses terpolymers of ethylene, unsaturated olefin and unsaturated ester for the manufacture of extruded, molded or drawn articles. Great Britain Patent No. 1,462,628 discloses terpolymers of ethylene, vinyl acetate and isobutylene used in hot melt coating processes.

SUMMARY OF THE INVENTION

It has been found that certain terpolymers prepared from ethylene, vinyl acetate and isobutylene are able to improve the flow properties of certain distillate fuels, such as No. 2 diesel fuel, as evaluated by PPD and CFPP performance. These terpolymers are particularly effective in improving the flow properties of hard-to-treat fuels, as defined herein. The terpolymers have a weight average molecular weight in the range of about 4,000 to about 18,000, a number average molecular weight in the range of about 1,600 to about 3,000, and a ratio of weight average molecular weight to number average molecular weight from about 2.8 to about 6.0. The terpolymer physically has an opaque, hazy appearance, and has a viscosity typically in the range of about 110 cP to about 160 cP at 140° C. This viscosity range is lower than expected for a terpolymer of this molecular weight.

DETAILED DESCRIPTION OF THE INVENTION

It has been found that ethylene-vinyl acetate (EVA) polymers useful as distillate fuel flow improvers, particularly in connection with hard-to-treat fuels, can be produced herein by utilizing isobutylene as a monomer along with ethylene and vinyl acetate. Since isobutylene is incorporated in the polymer chain, a terpolymer containing ethylene, vinyl acetate and isobutylene is produced. The product, produced as described below, is whitish and opaque at room temperature. Certain terpolymers as produced herein with controlled amounts of the isobutylene component are found to be effective in lowering the pour point of distillate fuels while also possessing the properties of good cold filter plugging point (CFPP) performance and good filterability. Specifically, ethylene-vinyl acetate-isobutylene terpolymers of the invention with methyl per 100 methylene group ratios of about 2 to about 15, preferably about 4 to about 12, are found to perform better than EVA copolymers of similar vinyl acetate content.

The ethylene-vinyl acetate-isobutylene terpolymers of the present invention are prepared by nonsolution, high pressure polymerization. In general, these procedures involve free-radical polymerization in a stirred autoclave reactor, designed to operate at high pressures of ethylene in a continuous manner. The pressure in the autoclave reactor may vary from about 10,000 psig to about 35,000 psig, wherein pressures from about 19,000 psig to about 30,000 psig are preferred. Vinyl acetate monomer is introduced into the aforesaid stirred autoclave reactor at a flow rate sufficient to produce a product containing about 30 to about 55 weight percent of vinyl acetate. The rate of isobutylene introduction depends on rate of vinyl acetate introduction, and may range from about 0.01 to about 1 times the rate of vinyl acetate monomer flow rate to the reactor; flow rates of isobutylene to the reactor that are preferred will be about 0.05 to about 0.75 times the rate of vinyl acetate monomer flow rate. In addition, the ethylene-vinyl acetate-isobutylene terpolymers of this invention have a viscosity of about 110 to about 160 centipoise (cP) as measured at 140° C. in a Brookfield Thermocel viscometer. Preferably, the viscosity of the terpolymer will be in the range of about 115 to about 140 cP.

A suitable chain transfer agent is also introduced into the reactor. Lower molecular weight methyl ketones and aldehydes are employed as chain transfer agents. Examples of the useful ketones are acetone, methyl ethyl ketone, methyl isobutyl ketone, and the like; examples of the useful aliphatic aldehydes are formaldehyde, acetaldehyde, propionaldehyde, isobutyraldehyde, and the like. Acetaldehyde and propionaldehyde are preferred, acetaldehyde being especially preferred. When acetaldehyde or propionaldehyde is used as the chain transfer agent, its flow rate is from about 0.01 to about 0.3, preferably about 0.02 to about 0.1, times the flow rate of vinyl acetate monomer to the autoclave reactor.

The polymerization process of this invention is carried out at temperatures of about 225° F. (107° C.) to about 475° F. (246° C.); a temperature of about 250° F. (121° C.) to about 450° F. (232° C.) is preferred. The temperature profile over the reactor may be held constant or it may be relatively broad, as much as about 150° F. (66° C.) in certain instances.

Free radical initiators are employed in the process of the invention. In general, these are peroxygen compounds, for example, hydroperoxides, dialkyl peroxides, peroxy acids and esters of peroxy acids and typically include tert-butyl hydroperoxide, di-tert-butyl peroxide, peracetic acid, tert-butyl peracetate, tert-butyl perpivalate (also known as pertrimethylacetate), tert-butyl peroctoate, di-sec-butyl peroxydicarbonate and the like.

Preferred initiators are tert-butyl perpivalate, tert-butyl peroctoate, and di-sec-butyl peroxybicarbonate. Two or more initiators may be used in a given polymerization.

When the polymerization process of this invention is performed as disclosed herein above, a terpolymer product is obtained that contains from about 30 to about 55 weight percent vinyl acetate, preferably from about 33 to about 48 weight percent vinyl acetate. The remainder of the terpolymer product will consist of ethylene and isobutylene in which ethylene makes up the major proportion. The isobutylene content is manifested largely in terms of a methyl to 100 methylenes ratio, as determined by proton nuclear magnetic resonance spectroscopy. A typical ethylene-vinyl acetate copolymer prepared by the process of this invention will exhibit a methyl to 100 methylenes ratio of about 2, but terpolymers containing increasing isobutylene content will have methyl to 100 methylenes ratios in the range of about 2 to about 15, preferably from about 4 to about 12.

The molecular weight of the terpolymers of the invention is also an important property in relation to their performance as flow improver additives to distillate fuels. Molecular weights may be determined, vapor pressure osmometry, by size exclusion chromatography (SEC), by gel permeation chromatography (GPC) or similar techniques. Both number average molecular weights (Mn) and weight average molecular weights (Mw) may be determined for the products of this invention by GPC or other method. The Mn of the useful terpolymers of this invention ranges from about 1,600 to about 3,000, preferably from about 1,900 to about 2,500; while the Mw of these terpolymers ranges from about 4,000 to about 18,000, preferably from about 6,000 to about 12,000. The ratio of Mw to Mn is in the range of about 2.8 to about 6.0.

The terpolymers of this invention exhibit a relatively high molecular weight distribution compared to conventionally prepared EVA cold flow improvers as indicated by the ratio of Mw to Mn. As a result, the terpolymers of this invention have a wider distribution of chain lengths, and therefore a wide distribution of ethylene sequences. Further, the terpolymers of the invention have a lower viscosity, indicating decreased intermolecular attraction. It is believed that these characteristics contribute at least in part to improved compatibility of the terpolymers with the range of n-paraffins in the distillate fuel, in turn resulting in improved performance of these terpolymers as flow improvers.

The terpolymers of the present invention act as flow improvers when effective amounts of the terpolymers are added to distillate fuels. Useful amounts of the terpolymers range from about 50 to about 1,000 ppm by weight of the fuel being treated. Preferred amounts of terpolymers to improve pour point depression range from about 50 ppm to about 250 ppm by weight of treated fuel. Preferred amounts of terpolymers to improve cold filter plugging point performance range from about 100 ppm to about 500 ppm by weight of treated fuel.

The terpolymers of this invention may also be used as a flow improver for heavier fuels, crude oils, and lubricating oils. Useful amounts of the terpolymers in this application range from about 1,000 to about 5,000 ppm, preferably about 1,000 to about 3,000 ppm by weight of the fuel, crude, or lubricating oil being treated.

The terpolymers of this invention may be used alone as the sole additive or in combination with other oil additives, such as corrosion inhibitors, antioxidants, sludge inhibitors, other cold flow improvers, and the like.

OPERATING EXAMPLES

The following detailed operating examples illustrate the practice of the invention in its most preferred form, thereby enabling a person of ordinary skill in the art to practice the invention. The principles of this invention, its operating parameters and other obvious modifications thereof, will be understood in view of the following detailed procedure.

Example 1

A mixture of ethylene, vinyl acetate, isobutylene and acetaldehyde was continuously pumped to a stirred high pressure autoclave reactor and reacted at a pressure of 22,600 psig. The catalysts used were di-sec-butylperoxydicarbonate and tert-butyl peroctoate which were separately introduced as solutions in mineral spirits at three distinct points in the autoclave reactor to control reaction temperature. The temperature in the autoclave was 399° F. (204° C.) at the bottom and 298° F. (148° C.) at the top. The vinyl acetate was pumped into the reactor at a rate of 2536 pounds per hour (pph). Isobutylene was pumped into the reactor at a rate of 175 pph. Acetaldehyde used as a chain transfer agent was pumped into the reactor at a rate of 66 pph. The vinyl acetate, isobutylene and acetaldehyde were combined with the ethylene stream prior to introduction of the mixture into the autoclave reactor. The final product had a vinyl acetate content of 45 weight percent and a viscosity of 120 cP at 140° C. The ratio of isobutylene to vinyl acetate on a weight basis was 0.07. The ratio of methyl groups per 100 methylene groups was 7.7 as measured by NMR. The number of chain transfer end groups per 1000 total carbons was 5.3 as measured by carbon-13 NMR. The sample produced according to this example is identified as Sample A in the Tables and discussion to follow.

Example 2

A mixture of ethylene, vinyl acetate, isobutylene and acetaldehyde was continuously pumped to a stirred high pressure autoclave reactor and reacted at a pressure of 22,600 psig. The catalysts used were di-sec-butyl peroxydicarbonate and tert-butyl peroctoate which were separately introduced as solutions in mineral spirits at three distinct points in the autoclave reactor to control reaction temperature. The temperature in the autoclave was 399° F. (204° C.) at the bottom and 298° F. (148° C.) at the top. The vinyl acetate was pumped at a rate of 2,025 pph. Isobutylene was pumped into the reactor at a rate of 258 pph. Acetaldehyde as a chain transfer agent was pumped into the reactor at a rate of 50 pph. The vinyl acetate, isobutylene and acetaldehyde were combined with the ethylene stream prior to introduction of the mixture into the autoclave reactor. The final product had a vinyl acetate content of 38 weight percent and a viscosity of 130 cP at 140° C. The ratio of isobutylene to vinyl acetate on a weight basis was 0.13. The ratio of methyl groups per 100 methylene groups was 8.2 as measured by NMR. The number of chain transfer end groups per 1000 total carbons was 3.6 as measured by carbon-13 NMR. The sample produced according to this example is identified as Sample B in the Tables and discussion to follow.

To demonstrate the advantages of the terpolymers of the invention, comparative evaluations were conducted on various fuels incorporating flow-improving additives. Pour point depression (PPD) performance and cold filter plugging point (CFPP) performance were evaluated for the various fuel components. The various fuels included fuels considered to be hard to treat.

The terpolymers of this invention are useful as additives for hard-to-treat fuels. These fuels have characteristics which render the fuel resistant to the effects of common cold flow improver additives. Factors affecting the response of a fuel to an additive include the boiling range of the fuel, the wax quantity of the fuel, and the wax distribution of the fuel. One useful distillation range for evaluating the characteristics of the fuel is the temperature differential between the 20% distillation temperature and the 90% distillation temperature (90%–20% temperatures) of the fuel (see ASTM D 86). If this range is less than about 100° C. for a middle distillate cut fuel, the distillate is characterized as narrow, and more difficult to treat with a flow improver. Such a fuel will have a faster rate of wax precipitation as the fuel cools, requiring that the additive be able to respond quickly to wax formation in the fuel.

Another important criterion for evaluating the fuel is the temperature difference between the 90% distillation temperature and the final boiling point (see ASTM D 86). A difference greater than about 25° C. up to about 35° C. for a middle distillate cut fuel indicates that heavier wax crystals are present in the fuel, which act as natural flow improvers. As this difference exceeds about 35° C., however, the quantity of heavier wax crystals reaches a level which renders the fuel hard to treat. A difference of about 25° C. or less indicates the virtual absence of heavier wax crystals and therefore the absence of natural flow improvers. A fuel within this narrowed range shows a poor response to flow improver additives and is considered hard to treat. Further, a fuel having a final boiling point less than about 360° C. or greater than about 380° C. has n-paraffin components, quantities, or both, which tend to render the fuel hard to treat.

Fuels included in the evaluation of the additives for CFPP performance are listed below in Table 1, which provides distillation data for the respective fuels according to test method ASTM D 86. The data indicate the boiling point temperature (°C.) at which specified volume percentages of the fuel have been recovered from the original pot contents, at atmospheric pressure.

TABLE 1

| | Percentage Distilled/Temperature (°C.) | | | | | | | | | | | | | |
|---|---|---|---|---|---|---|---|---|---|---|---|---|---|---|
| Fuel: | Initial B.P. | 5% | 10% | 20% | 30% | 40% | 50% | 60% | 70% | 80% | 90% | 95% | Final B.P. | % Residue |
| 1 | 178 | 204 | 213 | 226 | 237 | 249 | 259 | 270 | 283 | 297 | 314 | 327 | 352 | 0.6 |
| 2 | 141 | 199 | 211 | 226 | 237 | 249 | 260 | 273 | 286 | 301 | 324 | 341 | 356 | 0.0 |
| 3 | 197 | 217 | 224 | 236 | 245 | 251 | 261 | 270 | 279 | 290 | 306 | 315 | 345 | 0.8 |
| 4 | 222 | 239 | 244 | 251 | 260 | 268 | 274 | 283 | 293 | 305 | 322 | 334 | 356 | 0.2 |

Fuels included in the evaluation of additives for pour point depression performance are listed below in Table 2, which provides distillation data for the listed fuels similar to that provided in Table 1.

TABLE 2

| | Percentage Distilled/Temperature (°C.) | | | | | | | | | | | | | |
|---|---|---|---|---|---|---|---|---|---|---|---|---|---|---|
| Fuel: | Initial B.P. | 5% | 10% | 20% | 30% | 40% | 50% | 60% | 70% | 80% | 90% | 95% | Final B.P. | % Residue |
| 1 | 178 | 204 | 213 | 226 | 237 | 249 | 259 | 270 | 283 | 297 | 314 | 327 | 352 | 0.6 |
| 5 | 177 | 201 | 210 | 227 | 238 | 249 | 259 | 268 | 280 | 293 | 309 | 319 | 345 | 0.5 |
| 6 | 199 | 222 | 230 | 243 | 251 | 258 | 264 | 270 | 277 | 284 | 295 | 303 | 316 | 1.0 |
| 7 | 194 | 221 | 229 | 243 | 263 | 262 | 271 | 280 | 289 | 302 | 318 | 333 | 351 | 1.1 |
| 8 | 177 | 203 | 211 | 227 | 239 | 251 | 261 | 269 | 279 | 290 | 306 | 320 | 325 | 1.0 |

To evaluate whether the diesel fuels listed in Tables 1 and 2 would be considered hard to treat, the temperature difference between the 20% distilled and 90% distilled temperatures (90%–20%), and 90% distilled temperature and final boiling point (90%–FBP) were calculated. Also, the final boiling point was included. The data are provided in Table 3. A 90%–20% temperature difference of about 100°–120° C. for a middle distillate cut fuel is considered normal; a difference of about 70°–100° C. is considered narrow and hard to treat; and a difference of less than about 70° C. is considered extreme narrow and hard to treat. A 90%–FBP temperature difference in the range of about 25° C. to about 35° C. is considered normal; a difference of less than about 25° C. is considered narrow and hard to treat; and a difference of more than about 35° C. is considered hard to treat. A final boiling point below about 360° C. or above about 380° C. is considered hard to treat. Distillation data were generated by utilizing the ASTM D 86 test method.

TABLE 3

| | Temperature Difference (°C.) | | |
|---|---|---|---|
| FUEL | 90% - 20% | 90% - FBP | FBP (°C.) |
| 1 | 88 | 38 | 352 |
| 2 | 98 | 32 | 356 |
| 3 | 70 | 39 | 345 |
| 4 | 71 | 34 | 356 |
| 5 | 82 | 36 | 345 |
| 6 | 52 | 21 | 316 |
| 7 | 75 | 33 | 351 |
| 8 | 79 | 19 | 325 |

The physical properties of additives produced according to the procedures of Examples 1 and 2, along with two commercial ethylene vinyl acetate isobutylene terpolymer flow improver additives as comparison, are listed below in Table 4.

TABLE 4

| | Properties | | | | | |
|---|---|---|---|---|---|---|
| Additive | Vinyl Acetate wt % | Viscosity (cP) @ 140° C. | Solution Pour Pt.[3] °C. | Mn[4] | Mw[4] | Mw/Mn |
| Sample A | 45 | 120 | −76 | 2,067 | 6,438 | 3.1 |
| Sample B | 38 | 130 | <−82 | 2,237 | 11,664 | 5.2 |
| Commercial[1] A | 42 | 190 | −66 | 1,902 | 3,326 | 1.7 |
| Commercial[2] B | 35.5 | 175 | −70 | 1,986 | 3,563 | 1.8 |

[1]Commercially available ethylene-vinyl acetate-isobutylene terpolymer
[2]Commercially available ethylene-vinyl acetate-isobutylene terpolymer
[3]5% additive by wt. in toluene solution. Minimum temperature limit is −82° C.
[4]Derived from gel permeation chromatography (GPC) data In evaluating pour point depression performance (ASTM D 97), the additives from Table 4 were combined with Fuel 1 at a weight concentration of 150 ppm additive in fuel. In all evaluations herein the additive was combined with the fuel from a concentrate. One part of a 1:1 weight mixture of additive and xylene was combined with 19 parts by weight of the fuel to be evaluated to prepare the concentrate. The actual final weight concentration of additive in the fuel was adjusted by varying the appropriate amount of the concentrate added to the fuel. The pour point depression data and percentage improvement over the untreated fuel are provided below in Table 5.

TABLE 5

| Additive (in Fuel 1 @ 150 ppm conc. by weight | Pour Point (°C.) | % Improvement over Control |
|---|---|---|
| Control (no additive) | −21 | 0 |
| Sample A | −46 | 119 |
| Sample B | −42 | 100 |

TABLE 5-continued

| Additive (in Fuel 1 @ 150 ppm conc. by weight | Pour Point (°C.) | % Improvement over Control |
|---|---|---|
| Commercial A | −37 | 76 |
| Commercial B | −33 | 57 |

Sample A and Commercial A additives from Table 4 were individually incorporated at various concentration levels into various fuels listed in Table 2, and evaluated for effect on pour point depression (PPD) performance. The pour point depression data for concentration effect and percentage improvement for treated fuel over the untreated fuel are provided below in Table 6.

TABLE 6

| Additive | Additive Conc. by weight (ppm) | Fuel/Pour Point (°C.) 1 | 5 | 6 | 7 | 8 | Pour Point Sum for Fuels (C.°) | % Improvement over Control |
|---|---|---|---|---|---|---|---|---|
| Control (no additive) | — | −21 | −33 | −28 | −22 | −24 | −128 | 0 |
| Sample A | 50 | −32 | −40 | −36 | −30 | −30 | −168 | 31 |
| Sample A | 150 | −46 | −46 | −44 | −34 | −38 | −208 | 62 |
| Commercial A | 50 | −28 | −38 | −32 | −26 | −28 | −152 | 19 |
| Commercial A | 150 | −37 | −42 | −38 | −30 | −34 | −181 | 41 |

Sample A, Sample B, and Commercial A additives from Table 4 were individually incorporated into Fuel 1 at a widened range of concentration levels to evaluate the extent of improvement attributable to the sample additives relative to the commercial product. Pour point depression data for concentration effect and percentage improvement relative to untreated fuel are provided below in Table 7. Temperatures are in degrees Celsius. The improvement in pour point attributable to the Sample A and B additives over the commercial additive is particularly significant at low concentrations of additive.

TABLE 7

| Additive Conc. in Fuel 1 by weight (ppm) | Sample A Pour Point (% Improvement over Control) | | Sample B Pour Point (% Improvement over Control) | | Commercial A Pour Point (% Improvement over Control) | |
|---|---|---|---|---|---|---|
| 0 | −21 | (—) | −21 | (—) | −21 | (—) |
| 50 | −32 | (52%) | −30 | (43%) | −28 | (33%) |
| 100 | −41 | (95%) | −36 | (71%) | −32 | (52%) |
| 150 | −46 | (119%) | −42 | (100%) | −37 | (76%) |
| 250 | −47 | (124%) | −43 | (105%) | −43 | (105%) |
| 500 | −47 | (124%) | −46 | (119%) | −46 | (119%) |

Another method for evaluating the flow improving ability of the terpolymers of the invention is by CFPP performance (IP 309). The additives from Table 4 were combined with Fuel 1 at a weight concentration of 500 ppm additive in fuel. The cold filter plugging point (CFPP) data and percentage improvement over the untreated fuel are provided below in Table 8.

TABLE 8

| Additive (in Fuel 1) @ 500 ppm conc. by weight | CFPP (°C.) | % Improvement over Control |
|---|---|---|
| Control (no additive) | −15.5 | 0 |
| Sample A | Minimal effect on CFPP | — |
| Sample B | −39 | 152 |
| Commercial A | Minimal effect on CFPP | — |
| Commercial B | −29 | 87 |

Sample B and Commercial B additives from Table 4 were individually incorporated into various fuels listed in Table 1, and evaluated for effect on cold filter plugging point (CFPP) performance. The CFPP data and percentage improvement over the untreated fuels are provided below in Table 9.

TABLE 9

| Additive | Fuel/CFPP (°C.) 1 | 2 | 3 | 4 | CFPP Sum for Fuels (°C.) | % Improvement over Control |
|---|---|---|---|---|---|---|
| Control (no additive) | −15.5 | −20 | −31 | −11 | −77.5 | 0 |
| Sample B | −39 | −39 | −40 | −18 | −136 | 76 |
| Commercial B | −29 | −34 | −32 | −11 | −106 | 38 |

As the results from Tables 5 through 9 demonstrate, the flow improver additives of the invention may be effective in improving pour point performance only or both pour point and cold filter plugging point (CFPP) performance. The Sample A and B additives consistently demonstrated enhanced cold flow improving performance in all fuels tested relative to the Commercial A and B additives.

PPD performance is generally a primary factor for consideration in a refinery or fuel transport application, while CFPP performance is generally important in evaluating an additive for consumer use.

As the data indicate, the additives of the invention provide substantial improvements in PPD and CFPP performance relative to untreated fuel. Further, flow performance is improved in PPD and CFPP relative to commercial additives for hard-to-treat fuels, which are those having at least one temperature or temperature difference parameter identified herein as indicative of a hard-to-treat fuel. From the temperature difference and final boiling temperature data in Table 3, each of fuels 1 through 8 are considered hard to treat.

Other modifications and variations of the present invention are possible in light of the above teachings. Changes may be made in the particular embodiments of the invention which are within the full intended scope of the invention as defined by the appended claims.

What is claimed is:

1. A terpolymer for improving the flow properties of distillate fuels, said terpolymer comprising ethylene, vinyl acetate and isobutylene wherein the number average molecular weight of said terpolymer is from about 1,600 to about 3,000, the weight average molecular weight of said terpolymer is from about 4,000 to about 18,000, the ratio of weight average molecular weight to number average molecular weight of said terpolymer is from about 2.8 to about 6.0, and the vinyl acetate content of said terpolymer is from about 30 to about 55 weight percent.

2. The terpolymer of claim 1 wherein said number average molecular weight is from about 1900 to about 2500.

3. The terpolymer of claim 1 wherein said weight average molecular weight is from about 6000 to about 12000.

4. The terpolymer of claim 1 with a vinyl acetate content in the range of about 33 to about 48 weight percent.

5. The terpolymer of claim 1 with a viscosity at 140° C. in the range of about 110 cP to about 160 cP.

6. The terpolymer of claim 5 with a viscosity at 140° C. in the range of about 115 cP to about 140 cP.

7. A distillate fuel composition having improved flow properties comprising a major proportion of a distillate fuel and an improved flow property effective amount of a terpolymer comprising ethylene, vinyl acetate and isobutylene wherein the number average molecular weight of said terpolymer is from about 1600 to about 3000, the weight average molecular weight of said terpolymer is from about 4,000 to about 18,000, the ratio of weight average molecular weight to number average molecular weight of said terpolymer is from about 2.8 to about 6.0, and the vinyl acetate content of said terpolymer is from about 30 to about 55 weight percent.

8. The composition of claim 7 wherein said distillate fuel has a distillation temperature difference less than about 100° C. between the 20% distillation and 90% distillation volume fractions of said distillate fuel.

9. The composition of claim 7 wherein said distillate fuel has a distillation temperature difference of about 25° C. or less between the 90% distillation volume fraction and final boiling point of said distillate fuel.

10. The composition of claim 7 wherein said distillate fuel has a distillation temperature difference greater than about 35° C. between the 90% distillation volume fraction and final boiling point of said distillate fuel.

11. The composition of claim 7 wherein said distillate fuel has a final boiling point less than about 360° C.

12. The composition of claim 7 wherein said distillate fuel has a final boiling point greater than about 380° C.

13. The composition of claim 7 wherein said distillate fuel is diesel fuel.

14. The composition of claim 7 wherein said distillate fuel is No. 2 diesel fuel.

15. The composition of claim 7 wherein said terpolymer has a number average molecular weight from about 1,900 to about 2,500.

16. The composition of claim 7 wherein said terpolymer has a weight average molecular weight from about 6,000 to about 12,000.

17. The composition of claim 7 wherein said terpolymer has a vinyl acetate content in the range of about 33 to about 48 weight percent.

18. The composition of claim 7 wherein said terpolymer has a viscosity at 140° C. in the range of about 110 cP to about 160 cP.

19. The composition of claim 7 wherein said terpolymer has a viscosity at 140° C. in the range of about 115 cP to about 140 cP.

20. The composition of claim 7, wherein said terpolymer is added in an amount effective to depress the pour point temperature of said distillate fuel.

21. The composition of claim 7 wherein said terpolymer is added in an amount effective to depress the cold filter plugging point temperature of said distillate fuel.

22. The composition of claim 7 wherein said terpolymer is added in an amount effective to depress both the pour point temperature and the cold filter plugging point temperature of said distillate fuel.

23. The composition of claim 20, wherein the effective pour point depressant amount of said terpolymer is about 50 to about 250 ppm by weight of said distillate fuel.

24. The composition of claim 21 wherein the amount effective for depressing the cold filter plugging point is about 100 to about 500 ppm by weight of said distillate fuel.

* * * * *